US007838753B2

(12) United States Patent
Steele

(10) Patent No.: US 7,838,753 B2
(45) Date of Patent: Nov. 23, 2010

(54) ELECTRIC HIGH-HAT CIRCUITRY SYSTEM

(75) Inventor: Mark David Steele, New Smyrna Beach, FL (US)

(73) Assignee: Mark D. Steele, New Smyrna Beach, FL (US)

( * ) Notice: Subject to any disclaimer, the term of this patent is extended or adjusted under 35 U.S.C. 154(b) by 150 days.

(21) Appl. No.: 12/321,243

(22) Filed: Jan. 20, 2009

(65) Prior Publication Data

US 2010/0180750 A1 Jul. 22, 2010

(51) Int. Cl.
*G10D 13/02* (2006.01)

(52) U.S. Cl. ..... 84/422.1; 84/422.2; 84/422.3

(58) Field of Classification Search ..... None
See application file for complete search history.

(56) References Cited

U.S. PATENT DOCUMENTS 5,267,500 A * 12/1993 Lombardi ..... 84/402

5,438,903 A * 8/1995 Cropek ..... 84/422.3

* cited by examiner

*Primary Examiner*—Marlon T Fletcher

(57) ABSTRACT

An electronic high-hat circuitry system allows the drummer to manually choose the sounds that an electronic high-hat makes when the drummer's foot is off of the pedal and the high-hat instrument is struck. When the pedal is at or near the top of its travel, a primary circuitry switch disables normal foot-controlled positioning circuitry and enables a secondary circuit that sends a manually selected positioning signal to a drum module. When the pedal is again pressed down, the primary circuitry switch returns control to the primary, pedal controlled circuit. An optional tertiary circuit allows for the choosing of a different sound when the secondary circuit is activated and the high-hat cymbal is tilted, and is used primarily for accent notes. A control panel is used by the drummer to select the desired high-hat sounds of the secondary and tertiary circuits.

15 Claims, 15 Drawing Sheets

3/15

108
106
DRUM
MODULE
107
109
12
109
13
OPEN
CLOSE
111
14

ELECTRIC HIGH-HAT CIRCUITRY SYSTEM

REFERENCES CITED

U.S. Patent Documents:

| | | |
|---|---|---|
| 4,730,532 | March, 1988 | Bauerfeind |
| 4,928,567 | May, 1990 | Kurosaki |
| US 2005/0150349 A1 | July, 2005 | Susami |
| 5,028,776 | July, 1991 | Forti |
| 4,667,562 | May, 1987 | Lee |
| 7,268,284 B2 | September, 2007 | Lee |

STATEMENT OF FEDERALLY SPONSORED RESEARCH/DEVELOPMENT

None

REFERENCE TO SEQUENCE LISTING

None

BACKGROUND OF THE INVENTION

1. Field of the Invention

This invention relates to electronic percussion instruments such as electronic drums that electronically produce sounds simulating the sounds of acoustic drum sets including drums and cymbals.

2. Description of the Related Art

Electronic drums have been in use for several years now, and the technology is fairly straight forward. Put simply, a piezo electronic element generates a small but detectable current when the element is vibrated. These piezo elements are embedded into pads, cymbals or tubes, and the electrical output is routed to signal processors, commonly referred to as drum modules or "brains". Each piezo signal is assigned a sound by the drummer, through the programming function of the drum module. If a particular pad is assigned a snare drum sound, for example, a sound pattern is artificially generated by the drum module when electrical inputs from the pad are detected, and these sounds are routed out of the module for amplification. Literally hundreds of different sound patterns can be generated, and a typical drum set uses from 5 to 50 sounds, depending upon the sophistication of the drum set.

The high-hat instrument presents unique problems when it comes to generating an artificial sound pattern. The instrument that is simulated has two cymbals, one suspended over the other, as in FIG. 1. The upper cymbal 101 is suspended on a rod 103, and is spring-loaded up and away from the lower cymbal 102. A foot pedal 104, connected to the rod 103, is used to bring them together. The instrument makes a wide variety of sounds, depending upon the pressure exerted upon the pedal, the proximity of the cymbals, and the force with which the cymbal is struck. The instrument also makes a variety of sounds without striking; just pressing down with the foot brings the cymbals together, and makes a "chick" sound.

FIG. 2 shows a typical electronic high-hat arrangement that attempts to reproduce the sounds from the instrument depicted in FIG. 1. In order to simulate this instrument electronically, two inputs are needed; the position of the foot pedal 105 and the piezo signal from the impact sensitive electronic cymbal 108. The foot pedal 105 position is usually expressed to the drum module 106 through a voltage change that correlates to the pedal position. Typically, a constant voltage is sent to the pedal, resistors come into play as the pedal is depressed, the altered voltage is sent back to the drum module, and the module detects the difference in the voltage. In some cases, a potentiometer is used to vary the voltage of the positional signal as the pedal is raised or lowered. Both the cymbal and the pedal are connected to the module using electrical cables 107, 109. A corresponding sound is generated in the drum module 106 based upon these two inputs. Note that there is no rod connecting the pedal to the high-hat cymbal.

As more bass drum notes became desirable in modem music, a second bass drum pedal was introduced, enabling drummers to play bass drum notes with both feet. Unfortunately, this requires drummers to take their foot off of the high-hat instrument, which leaves the upper cymbal suspended above the lower one in acoustic drum sets. To make matters worse, metal high-hat cymbals are generally very thick and produce an unpleasant "clanging" noise when they are struck without contacting their paired lower cymbal. Therefore, removing the foot from the high-hat generally renders the instrument un-playable, and most drummers immediately switch to a ride cymbal even though a high-hat sound is desired.

FIG. 1 shows a conventional acoustic high-hat in the at-rest position, which is achieved using a lifting spring. Pedal 104 is fully raised and attached to rod 103 and that cymbal 101 which is also attached to rod 103 is thereby also fully raised. Note the undesirable gap between cymbals 101 and 102.

In FIG. 1*a*, the pedal 104*a* has been depressed, the paired cymbals 101*a* and 102*a* have been drawn together, and the high-hat is ready for playing.

There are a few inventions on the market that attempt to make the acoustic high-hat playable when the foot is removed, and they usually involve a locking device that holds the pedal down when the foot is pulled away. When the locking device is disabled, the hi hat works normally again. The problem is that levers must be manipulated while trying to play the drums in order to lock or unlock a mechanical dutch, and it is sometimes difficult to consistently get the correct pedal pressure. Most drummers simply abandon the high-hat instrument rather than work the clutch mechanism. There are also devices that use light beams to sense when the drummer's foot has left the pedal, and an electromagnetic solenoid is activated to physically move the pedal to a preset position. These devices are expensive and complex, not suitable for most electronic high-hat control pedals, and are rarely used.

Unfortunately, prior art electronic high-hat devices have mimicked the conventional high-hat instrument all too well. When the foot leaves the instrument, this same irritating danging noise is generated by electronic high-hats, and the instrument is generally abandoned when a second bass drum pedal is used.

My invention solves this problem, allowing the drummer that uses an electronic high-hat to continue to generate pleasant closed high-hat sounds when the drummer's foot leaves the high-hat instrument, utilizing a secondary circuit to manually set the sound that the instrument will make. An optional tertiary circuit is introduced, that produces yet another selectable sound when the high-hat cymbal is tilted when struck by the drummer.

BRIEF SUMMARY OF THE INVENTION

An objective of the invention is to allow a drummer playing an electronic high-hat to continue to make pleasant high-hat sounds when the drummer's foot leaves the high-hat pedal.

Another objective is to have a primary circuitry switch that disables the primary pedal actuated positioning circuit when the foot is removed from the high-hat pedal, said primary circuitry switch simultaneously activating a secondary circuit that is energized when the drummer's foot leaves the high-hat pedal.

Yet another objective is to have electronic controls in the secondary circuit that manually vary the current of the high-hat positioning signal that is sent to the drum module.

A further objective is to provide accent notes using an optional tertiary circuit that controls the output to the drum module when the secondary circuit is activated and the high-hat cymbal is tilted after being impacted.

Another objective is to place a control panel within easy reach of the drummer that determines the sound that the high-hat will make when the instrument is struck whenever the foot is removed, with simple manual controls for setting the output of the secondary and tertiary circuits.

A further objective is to have a system that works in every configuration of electronic high-hat instruments.

In accordance with a preferred embodiment of the invention, there is disclosed an electronic high hat circuitry system that utilizes a primary, foot pedal controlled circuit that sends a positioning signal to an electronic drum module, a primary circuitry switch that is activated when the pedal is at or near the top of its travel thereby disabling the primary circuit and simultaneously activating a secondary circuit. This secondary circuit varies the positioning signal to the electronic drum module in a manner similar to the primary circuit with one major difference; the signal is manually set by the drummer through a control panel. An optional tertiary circuit is introduced, which allows the drummer to select a sound that is yet again different from the primary or secondary circuits.

This tertiary circuit is primarily used for accent notes, and it is activated when the secondary circuit is in use and the cymbal is tilted. This tertiary circuit signal is also manually selected by the drummer.

Other objectives and advantages of the present invention will become apparent from the following descriptions, taken in connection with the accompanying drawings, wherein, by way of illustration and example, an embodiment of the present invention is disclosed.

BRIEF DESCRIPTIONS OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 1 depicts an acoustic high-hat in the open, at-rest position.

FIG. 1*a* depicts a high-hat with the pedal depressed.

Figure 4A:
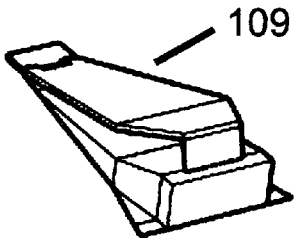

FIG. 4*a* depicts a prior-art electronic high-hat control pedal.

Figure 4B:
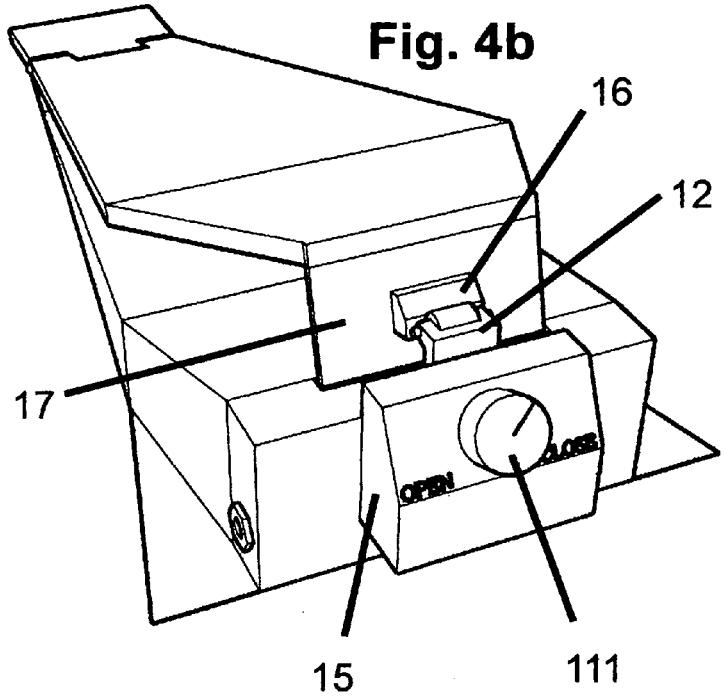

FIG. 4*b* depicts a high-hat pedal with a retrofitted external secondary circuit and a control panel.

Figure 4C:
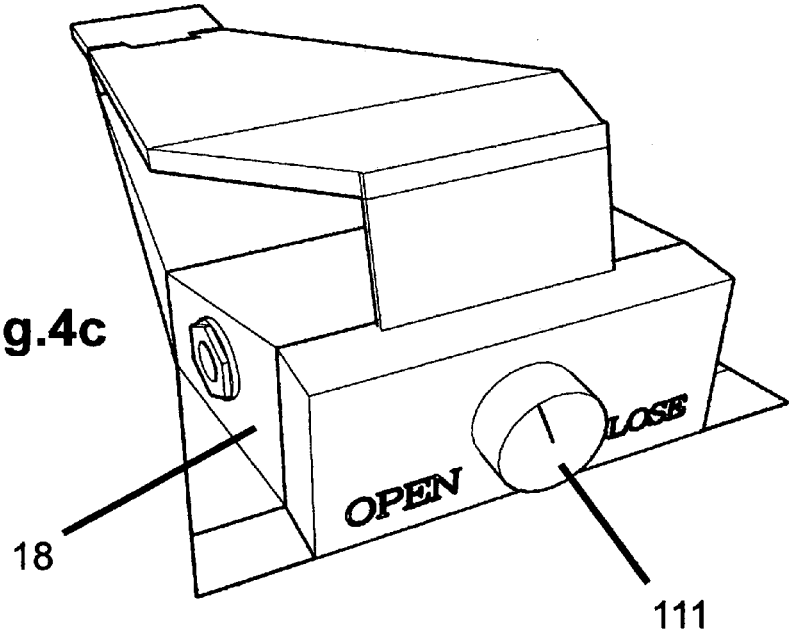

FIG. 4*c* depicts an electronic high-hat pedal with an internal secondary circuit and an external control panel.

Figure 5A:
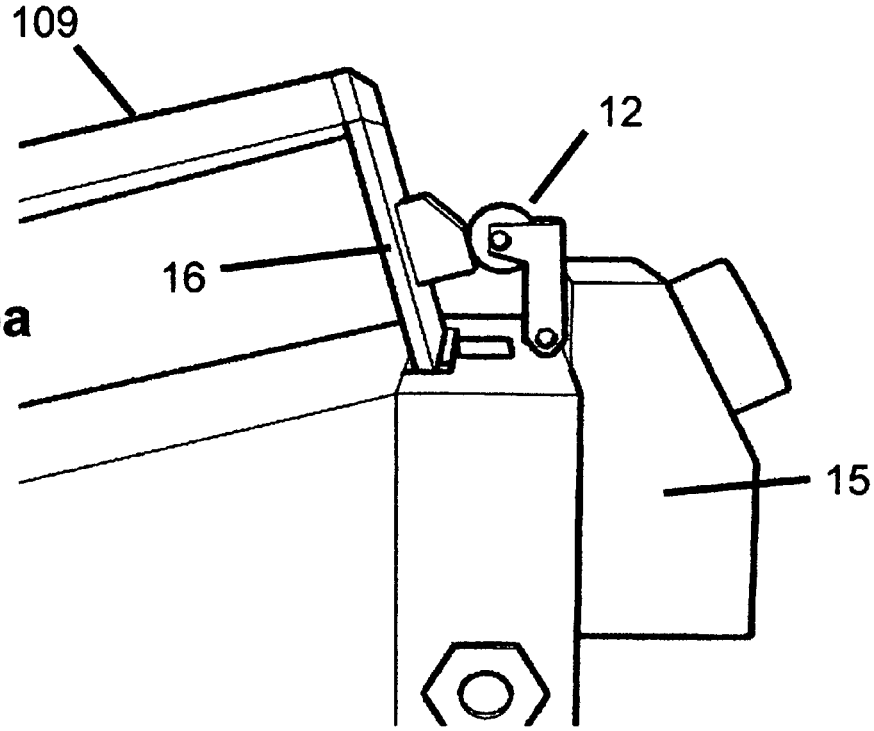

FIG. 5*a* depicts a primary circuitry switch when the pedal is in the at-rest, full up position.

Figure 5B:
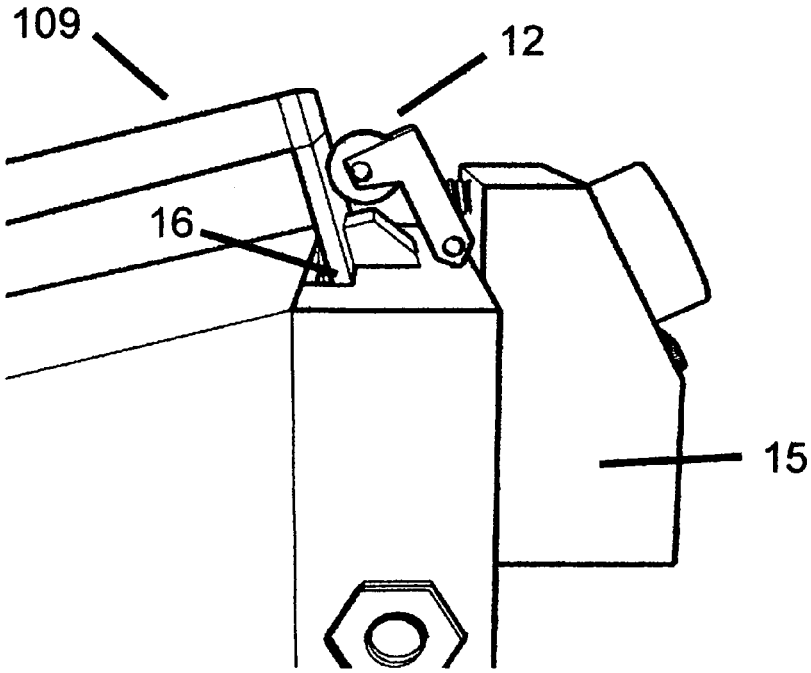

FIG. 5*b* depicts a primary circuitry switch when the pedal has been depressed.

Figure 6:
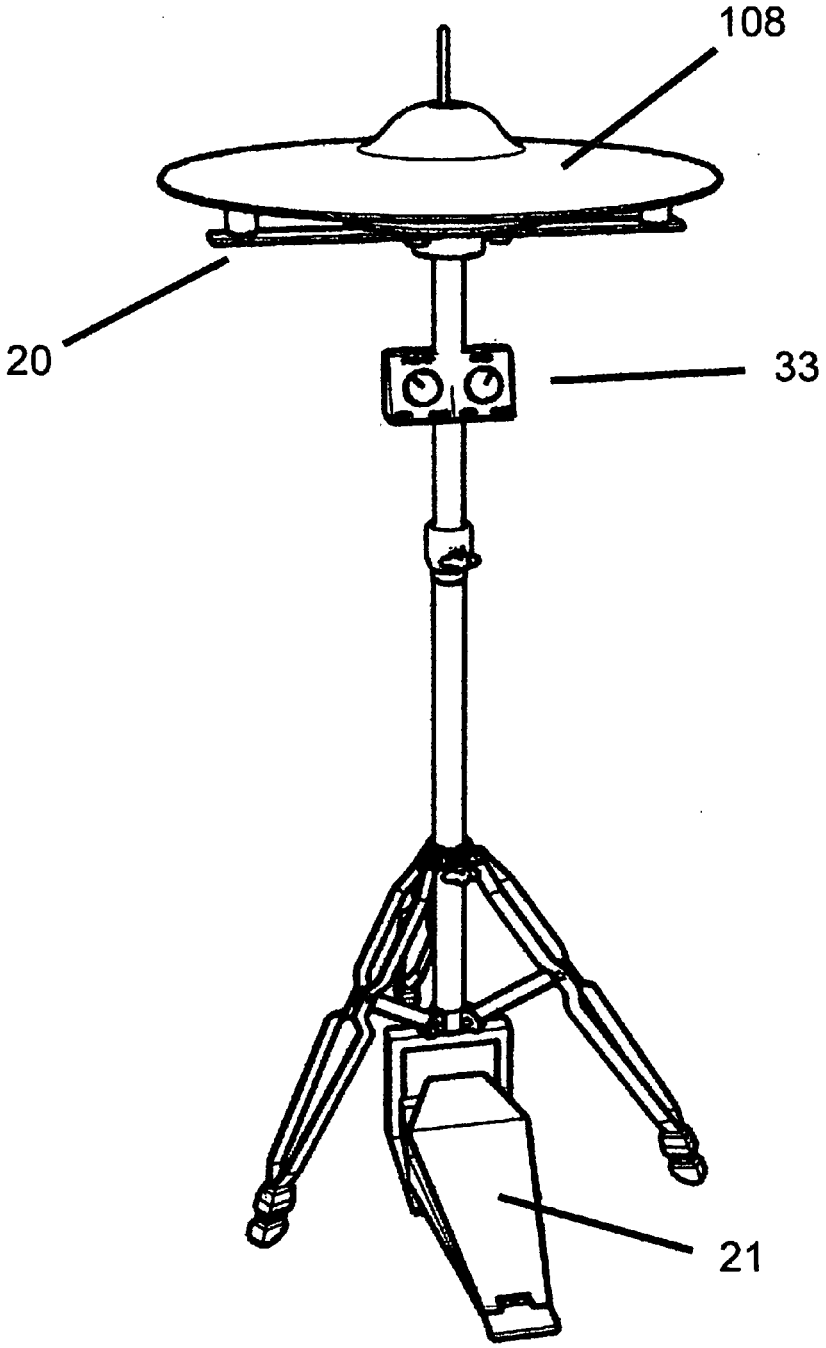

FIG. 6 depicts an embodiment of the invention with a tertiary circuit.

Figure 7A:
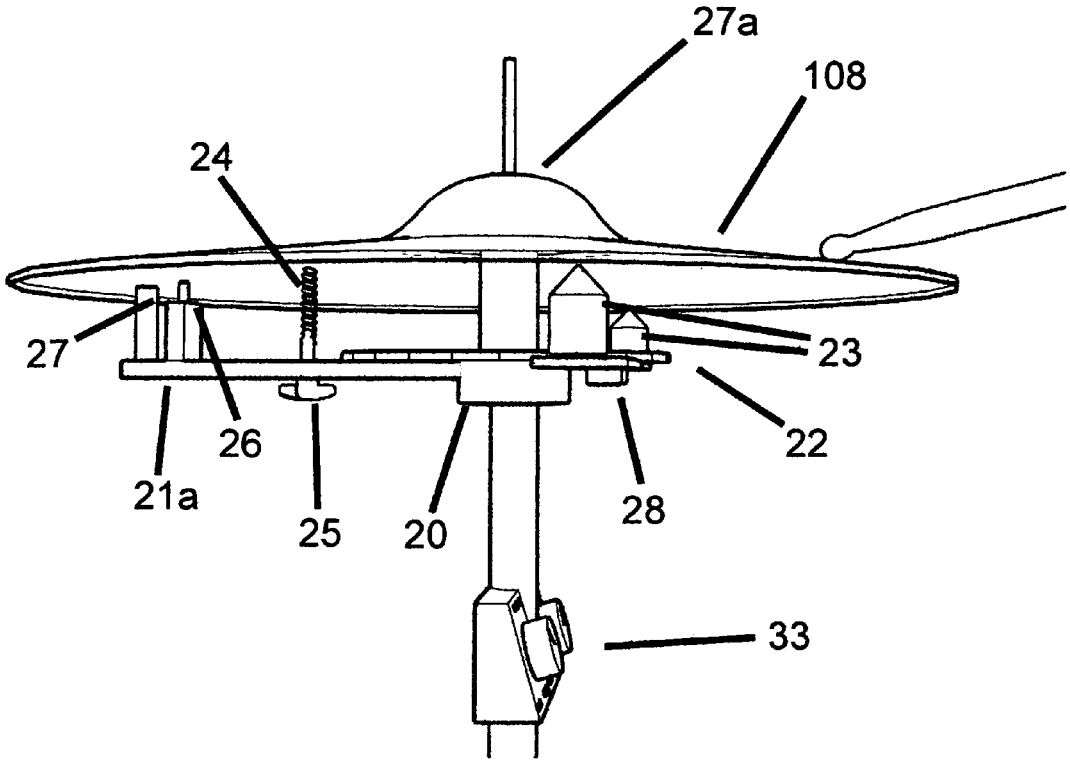

FIG. 7*a* depicts a tertiary circuit cymbal platform with the cymbal in the at-rest position.

Figure 7B:
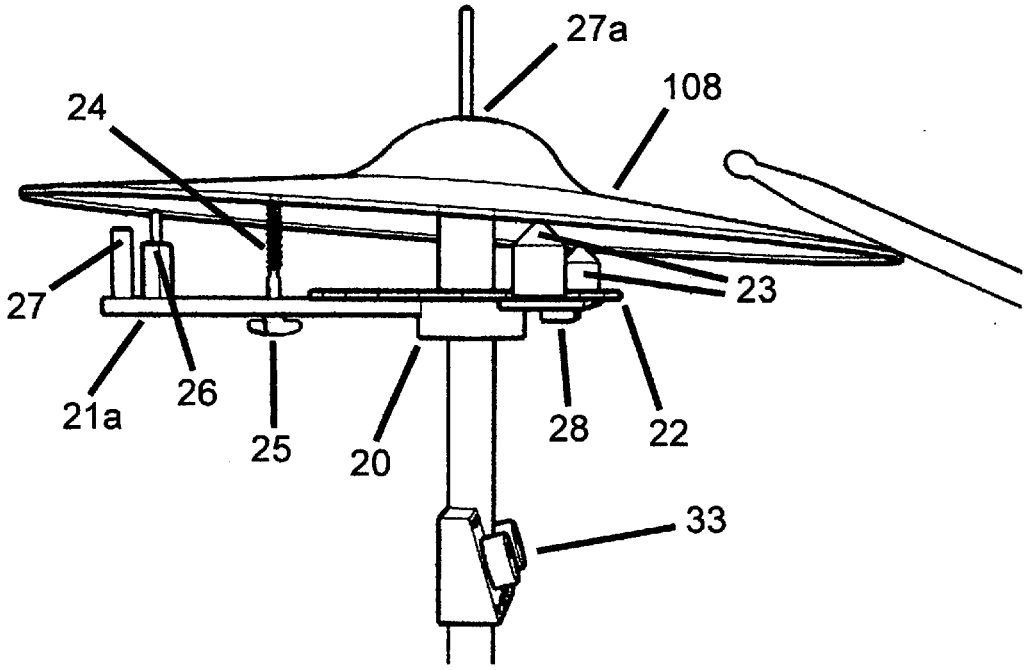

FIG. 7*b* depicts a tertiary circuit cymbal platform with the cymbal that has been tilted by the drummer.

Figure 7C:
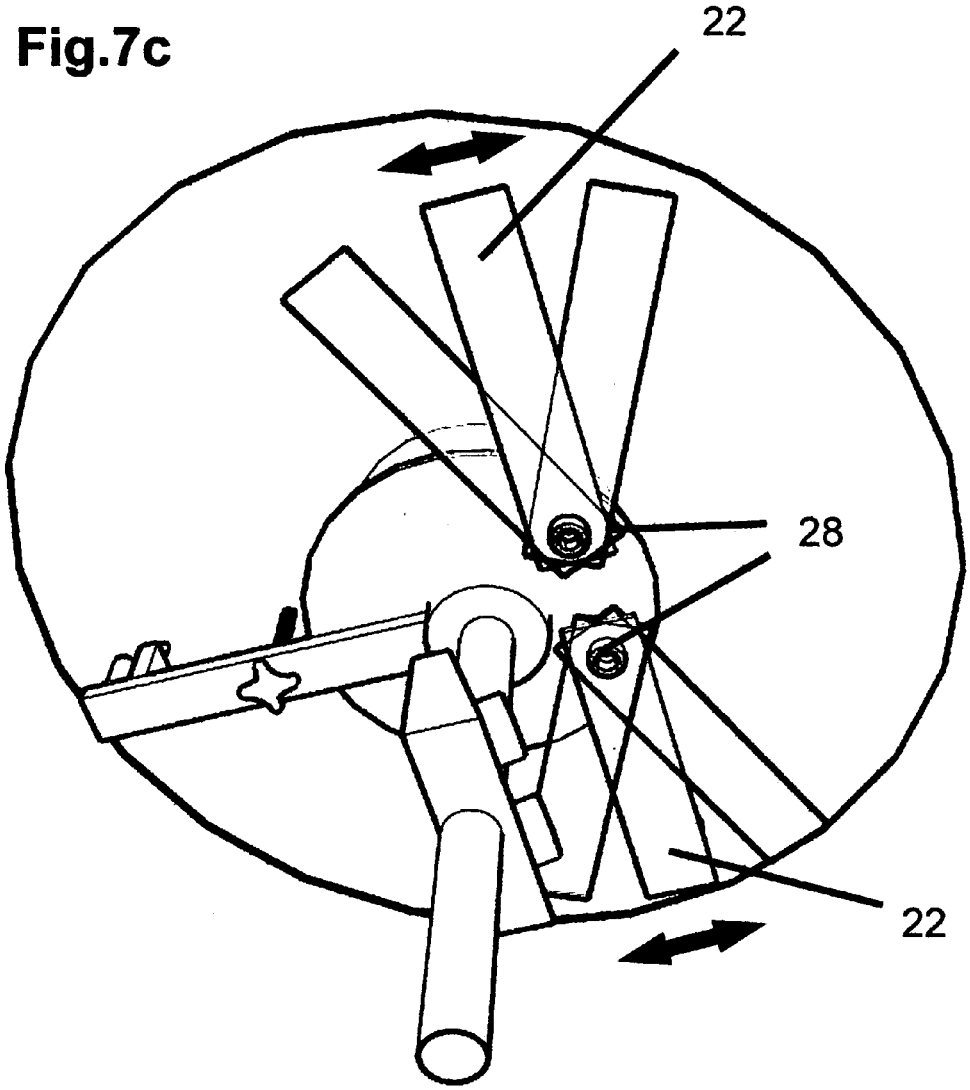

FIG. 7*c* depicts the underside of a tertiary circuit cymbal platform with adjustably positioned cymbal stanchion arms.

Figure 8A:
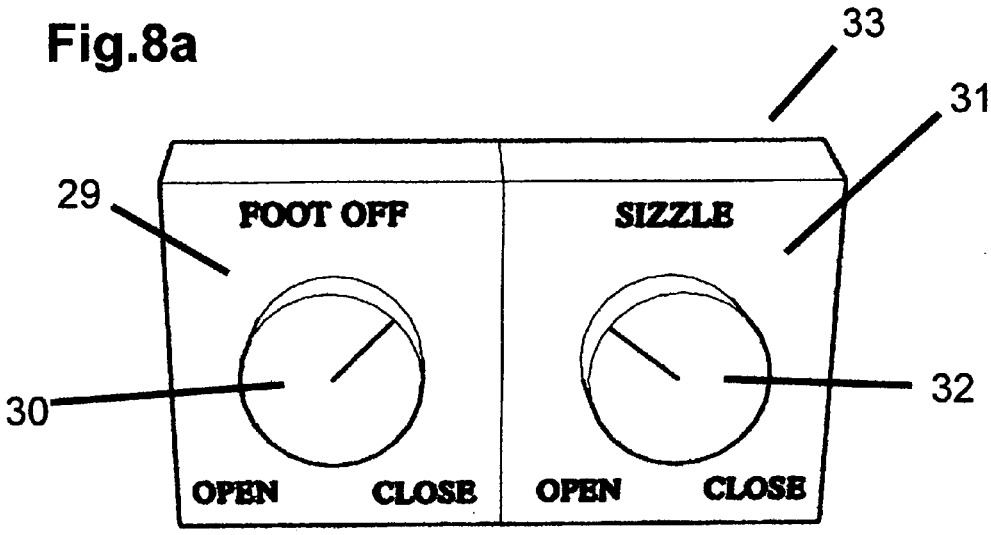

FIG. 8*a* depicts a secondary and tertiary "sizzle" circuitry control panel.

Figure 8B:
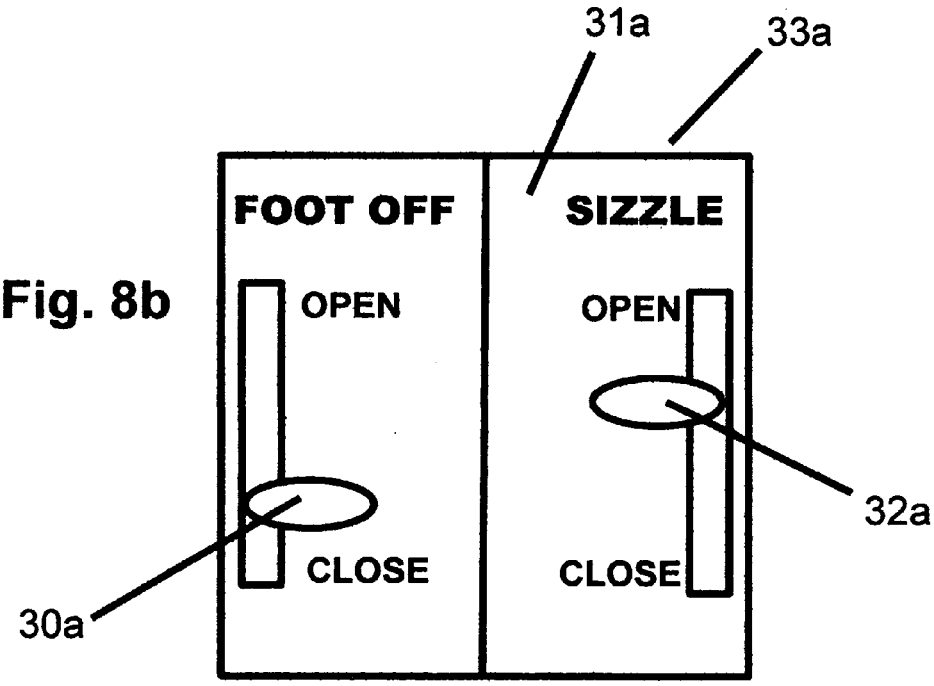

FIG. 8*b* depicts a control panel with slider control devices

Figure 9A:
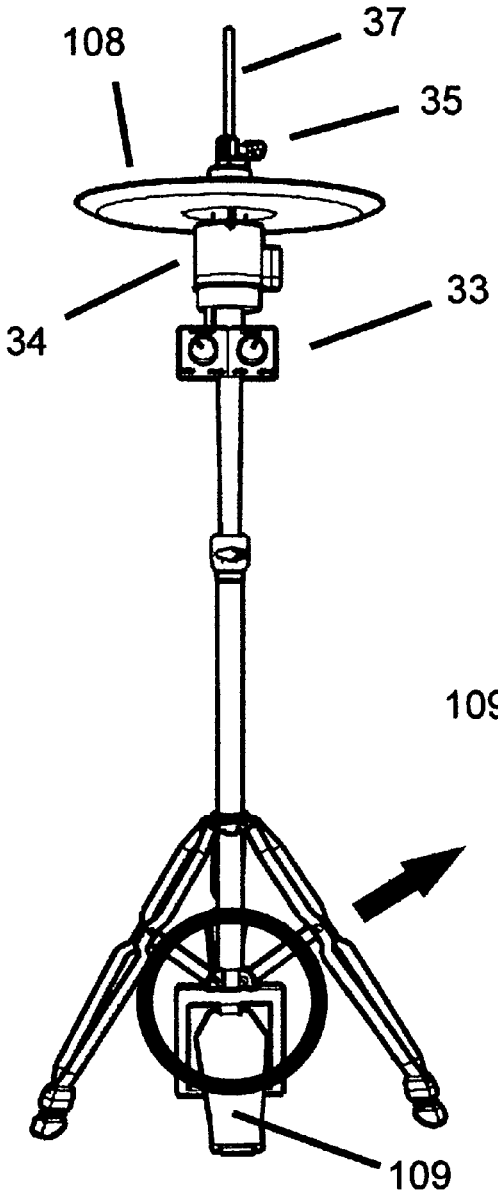

FIG. 9*a* depicts a generic modern electronic high-hat.

Figure 9B:
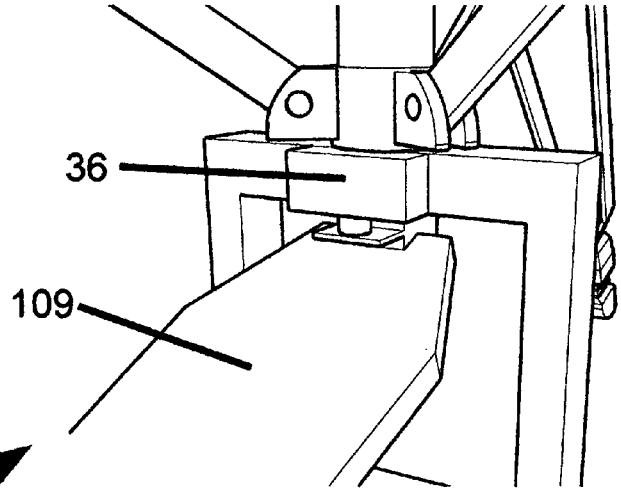

FIG. 9*b* depicts the base of a generic modern electronic high-hat device with the primary circuitry switch mounted above the pedal.

Figure 9C:
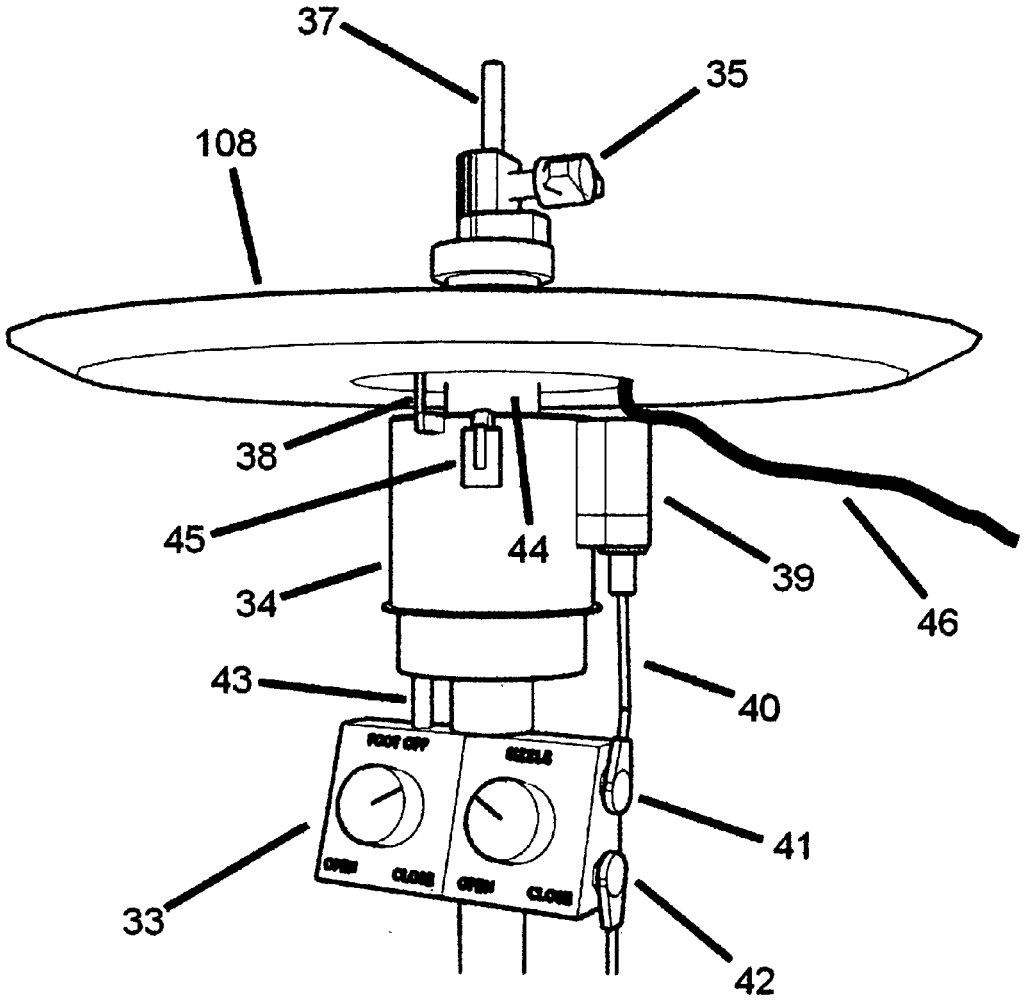

FIG. 9*c* depicts details of a generic modem electronic high-hat.

Figure 10A:
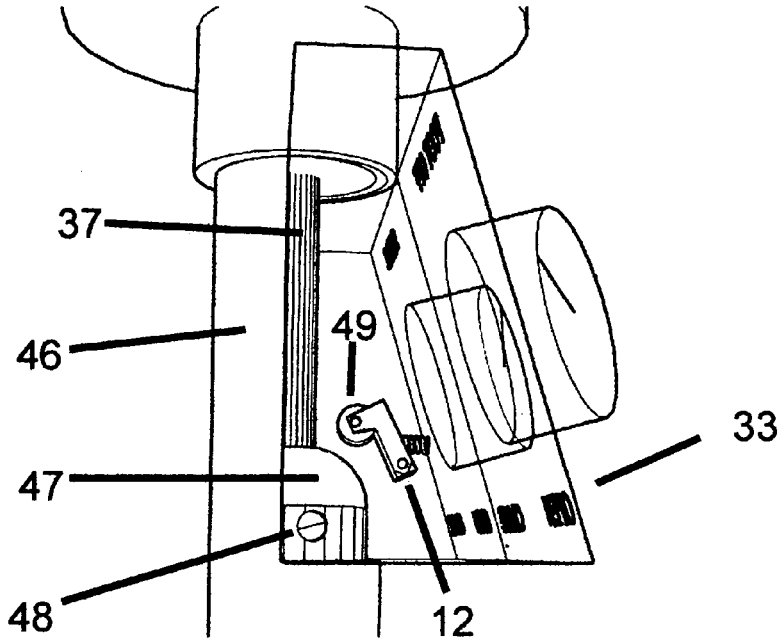

FIG. 10*a* depicts a primary circuitry switch that is contained within the electronics control box when the foot pedal is depressed.

Figure 10B:
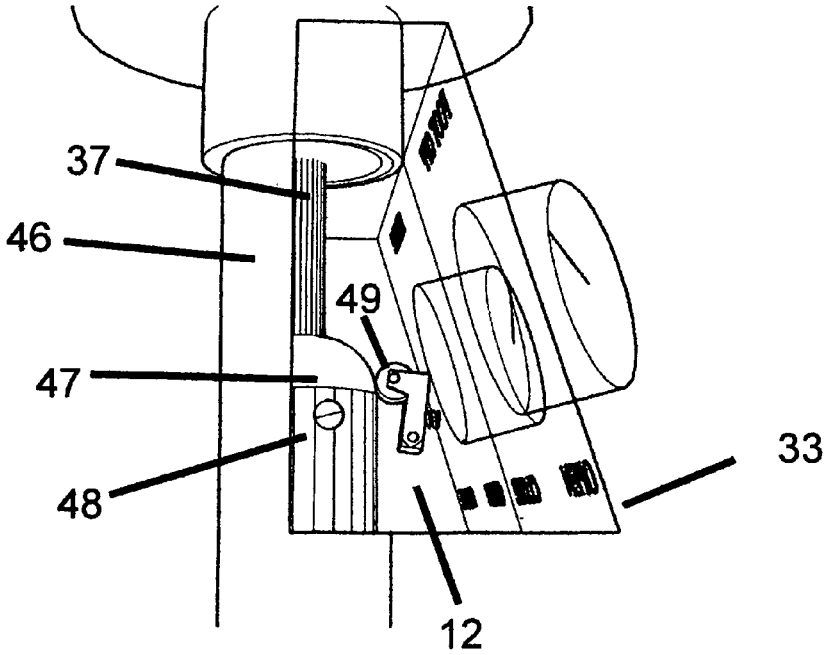

FIG. 10*b* depicts a primary circuitry switch that is contained within the electronics control box when the foot pedal is at-rest.

Figure 11A:
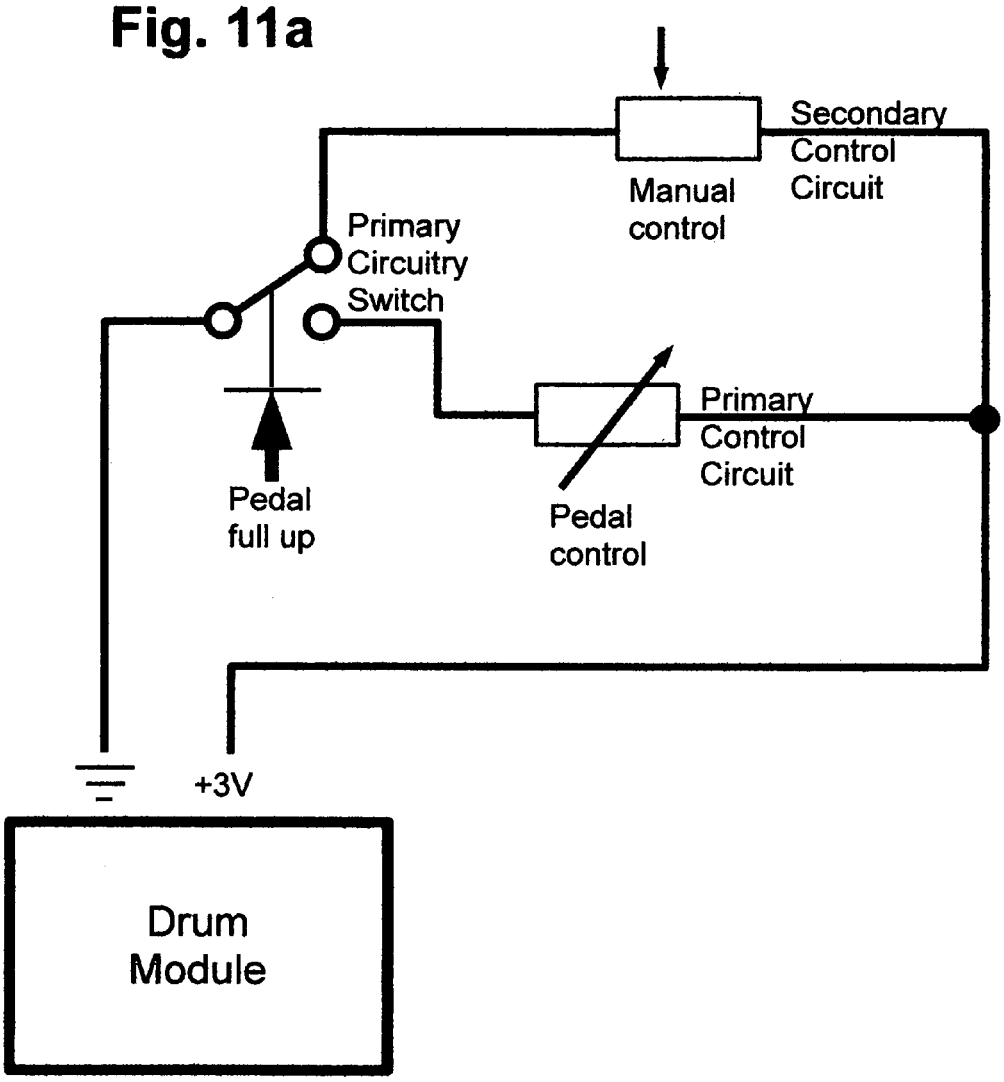

FIG. 11*a* depicts the circuitry logic of an electronic high-hat circuitry system having primary and secondary control circuits.

Figure 11B:
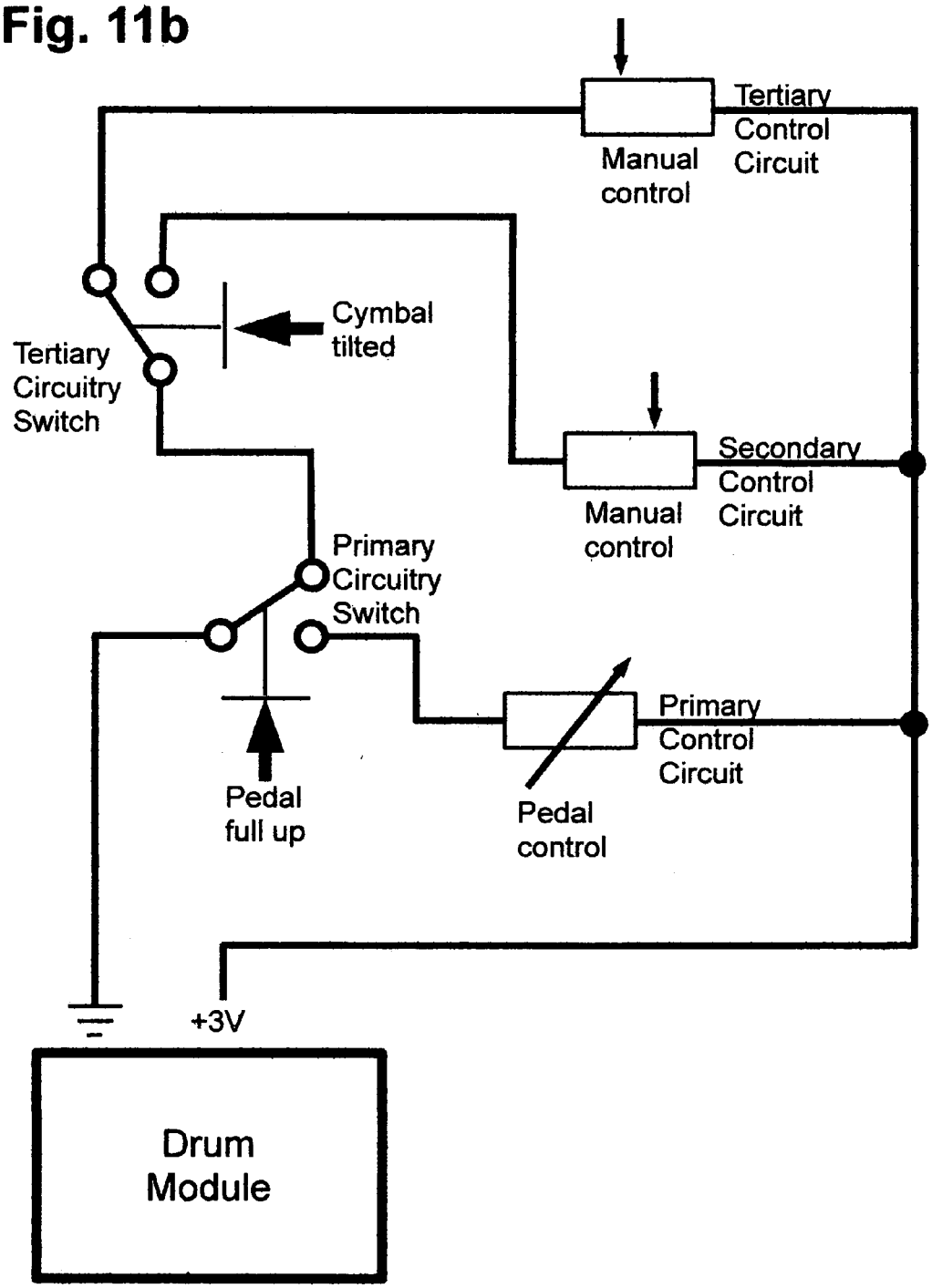

FIG. 11*b* depicts the circuitry logic of an electronic high-hat circuitry system having primary, secondary and tertiary control circuits.

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

There are many different configurations used in electronic high-hat instruments, and my invention works with all of them. In my Figures, I will use common numbering for the parts that serve identical functions, regardless of configuration differences.

Figure 1:
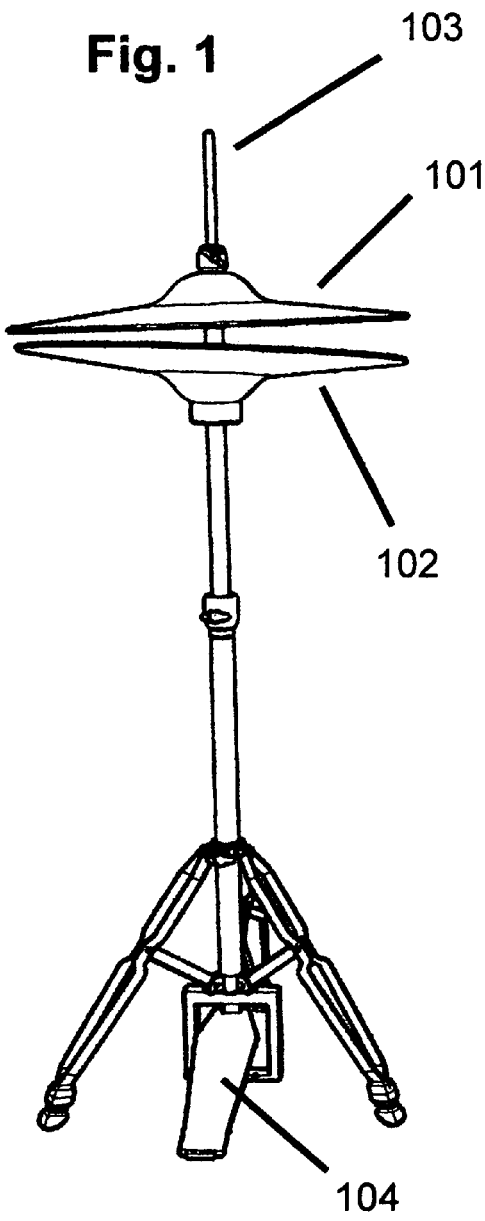
Figure 1A:
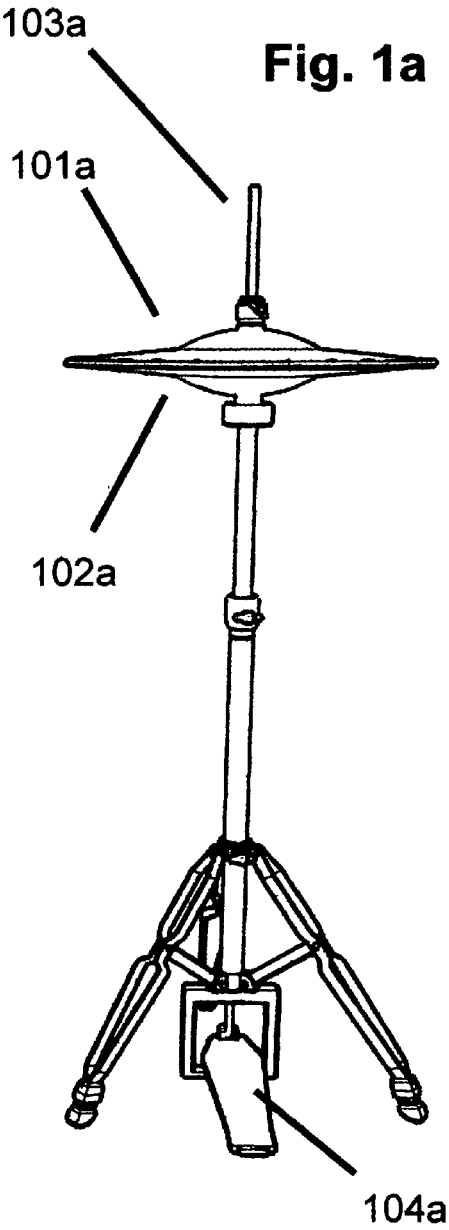
Figure 2:
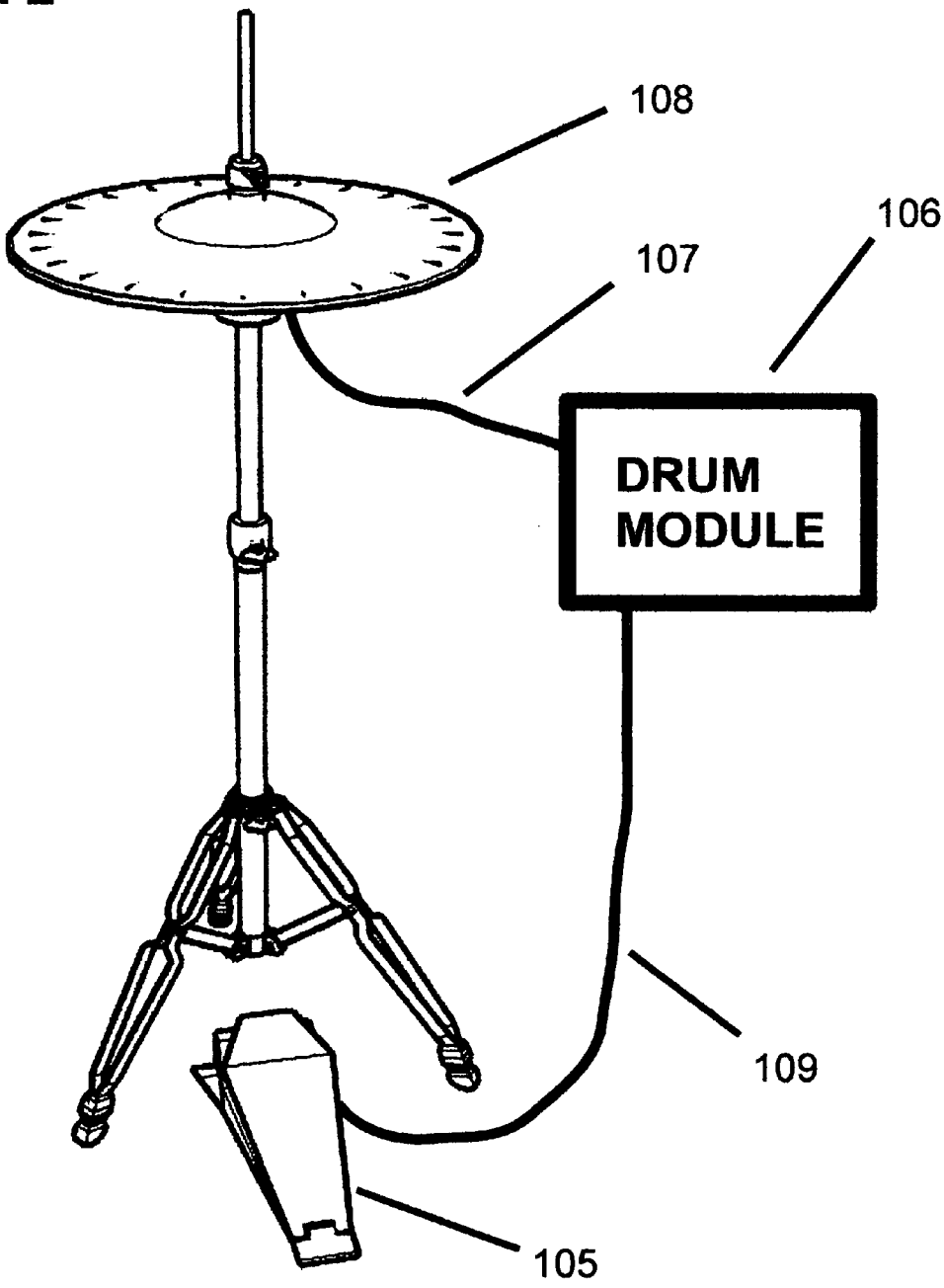
FIG. 2 depicts a typical electronic high-hat arrangement.
Figure 3:
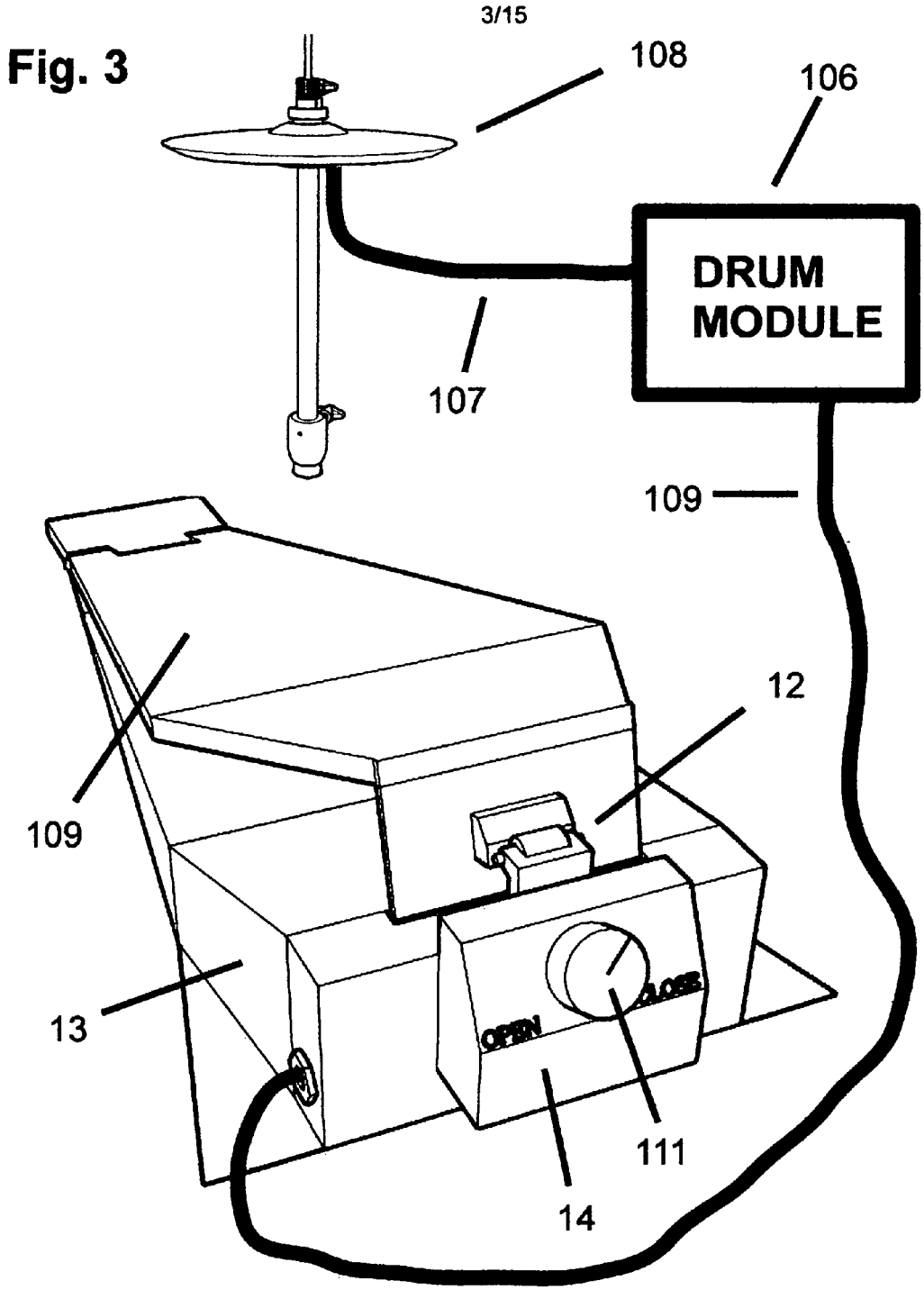
FIG. 3 depicts the basic elements of my invention.

These are the basic elements that are always present in my invention (see FIG. 3): an impact sensitive electronic cymbal or other electronic triggering device 108; a foot pedal which has an at-rest position that is at the top of its travel length 109, a primary control circuit 13, which varies the control current sent to the drum module 106 based upon foot pedal 109 position; a secondary circuit 14 which varies the control current sent to the drum module based upon a manual setting; a primary circuitry switch 12 that disables the primary circuit and energizes the secondary circuit when the pedal 109 is at or near the full-up, at-rest position; and a manual control knob 111 that allows the drummer to select the desired high-hat sound produced by the secondary circuit.

The secondary circuit varies the current to the drum module just like the primary positioning circuit with one major difference; the current is varied by means of a control knob, and not the position of the foot pedal. Using this control, the drummer can preselect a sound ranging from a full dosed to a full open high-hat, and when the foot is removed, this is the control signal that will be sent to the drum module. When the foot is again placed on the pedal and pressed down, the switch contact is broken, the secondary circuit is disabled, and the primary positioning circuit controlled by the foot pedal is utilized once again.

FIG. 4*a* shows a prior-art electronic high-hat control pedal, wherein the foot pedal 109 is part of a pedal assembly that houses and directly controls the primary control circuit. FIG. 4*b* shows the same pedal assembly that has been retrofitted with a primary circuitry switch 12, an external secondary circuit box 15 with manual control knob 111, and a primary circuitry switch cam 16 that has been mounted to the pedal plunger 17.

FIG. 4*c* shows an electronic high-hat control pedal with a secondary circuit built into the existing electronics bay 18 that forms the base of the pedal. The primary circuitry switch (not shown) is internally mounted, and has the same function as the retrofitted example in FIG. 4*b*. The control knob 111 still determines the sound that the pedal will make when the foot is removed.

FIGS. 5*a* and 5*b* show a typical foot pedal primary circuitry switch in use. When the pedal 109 is in the full-up position as in FIG. 5*a*, the primary circuitry switch cam 16 forces the primary circuitry switch 12 towards the secondary circuit box 15, activating the secondary circuit. As the pedal is depressed as in FIG. 5*b*, the primary circuitry switch 12 moves, the secondary control circuit is deactivated, and the primary control circuit in the foot pedal is activated. A circuitry logic diagram is presented in FIG. 11*a*, starting with a typical 3 volt power supply from the depicted drum module. In this example, a voltage change is produced by all control circuits, and this voltage change is detected by the drum module and used to produce an appropriate high-hat sound.

FIG. 6 depicts another embodiment of my invention. The foot pedal assembly 21 includes the pedal, the primary control circuit electronics, along with an internal primary circuitry switch. The electronics control box 33 includes a front control panel, and contains the secondary and tertiary circuitry. There is a tertiary circuit cymbal platform 20 and an impact sensitive electronic cymbal 108.

A favorite trick of all drummers is to raise the high-hat pedal slightly when hitting accent notes, and getting a momentary "sizzle" sound from the high-hat. My invention allows the drummer to control these accent notes, for the first time, when their foot is off of the pedal, utilizing an optional tertiary control circuit. When the cymbal is tilted as in FIG. 7*b*, the tertiary circuitry switch 26 is actuated, and transfers control to the tertiary circuit. The control knob 32 for the tertiary circuit has been labeled "sizzle" on the right side of the control panel 31 in FIG. 8*a*, and so has the slider device 32*a* on the right side of the control panel 31*a* in FIG. 8*b*. This tertiary "sizzle" circuit remains active for as long as the cymbal is tilted and the foot pedal is not depressed. The switches, resistors, potentiometers or other electronic parts used by the secondary and tertiary circuits to vary the positioning current are housed in the electronics control boxes 33 and 33*a*. In FIG. 8*b*, slider device controls are depicted. These slider device controls 30*a* and 32*a* may utilize potentiometers, progressive resistors, or other electronic devices to vary positioning current.

Note that the tertiary "sizzle" circuit is only armed when the drummer's foot is off of the pedal. When the drummer's foot is on the pedal, the primary circuit pedal position controls the output to the drum module regardless of cymbal tilt. A circuitry logic diagram is presented in FIG. 11*b*, starting with a generic 3 volt power supply from the depicted drum module. In this example, a voltage change is produced by all control circuits, and this voltage change is detected by the drum module and used to produce an appropriate high-hat sound.

FIGS. 7*a* and 7*b* show details of the tertiary circuit cymbal platform 20. The cymbal 108 is shown transparently in the drawings, and would include one or more piezo or other electronic triggers which are not shown. There is a central support post 27 that allows the cymbal to pivot at the center, and two fulcrum stanchions 23 mounted on two support arms 22. The central support post 27 could be made out of a flexible material, or the cymbal may have a flexible gimbal at the top. As the cymbal tilts in FIG. 7*b*, the two arms with stanchions define a fulcrum line for the cymbal to tilt in a direction facing the drummer. If the cymbal were allowed to tilt in a random direction, the response of the tertiary circuitry switch 26 may become unreliable. These arms 22 can be adjustably positioned relative to the pivot point of the support post 27 using adjustment screws 28 in FIG. 7*c*, and the height of the fulcrum stanchions 23 is also adjustable (FIGS. 7*a*, 7*b*). When the cymbal edge is pressed down when struck as in FIG. 7*b*, the cymbal tilts while being supported and guided by the fulcrum stanchions 23, and the tertiary circuitry switch 26 is activated. There is an arm 21 that supports the tertiary circuitry switch 26, the return spring assembly 24 and 25, and the return stop 27. An adjustment device 25 is shown which varies the tension of the return spring. The return spring or other elastic device 24 is attached to the cymbal 108 and it brings the cymbal back to an at-rest position that deactivates the tertiary circuit, as depicted in FIG. 7*a*. In the at-rest position, the cymbal is supported by the return stop 27. If the return stop 27 is constructed of a soft material, the cymbal will not trigger a sound when the cymbal falls to the at-rest position. If this return stop 27 is made of a solid material, the cymbal will trigger a sound as if struck. The drummer can thereby double the number of notes played, getting a second note each time the cymbal drops.

Some of today's most advanced electronic high-hats do not have the positioning control circuit housed in the foot pedal as in FIG. 4*a*, but in the actual cymbal assembly. In these designs, the cymbal that is struck by the drummer is attached to a rod that is connected to the foot pedal, as in conventional acoustic high-hats. As the pedal goes up and down, the electronic cymbal also moves. Highly sophisticated pressure sensors or elastic switches are used to vary the control current sent to the drum module. Since my design does not modify the control function of primary circuit mechanisms, my invention works with all types of existing electronic high-hats.

FIG. 9*a* depicts a modified generic modern electronic high-hat with the primary control circuit electronics housed at the top of the high hat stand. The foot pedal 109 is connected to a rod 37 that connects to a device that controls the primary control circuit, in this case, a device that resides in the primary circuit housing 34.

Rod 37 runs all the way through the instrument, and connects with the pedal 109 at the bottom. The cymbal 108 is attached to the rod using a clamp 35. The rod is spring-loaded to the full up position, as in conventional high hats. As the drummer's foot is lowered, this movement is sensed by the primary circuit pressure sensors (not depicted) which reside inside the primary circuit housing 34 and the primary control current is varied.

Some modifications are required in order to play the high hat when the foot is removed, and these modifications are shown in FIGS. 9*a,* 9*b* and 9*c*. Secondary and Tertiary circuits have been added, along with corresponding controls 33.

In FIG. 9*b,* a primary circuitry switch 36 has been added to the base of the stand, and this switch has the same function as in previous embodiments. A disadvantage to this arrangement is that there needs to be an electrical connection between the switch and the other components at the upper end of the high-hat stand. An external cable would be unsightly.

In FIG. 9*c,* an alternative primary circuitry switch 45 is depicted. As the foot pedal forces the cymbal downward, the compressor cylinder 44, which is part of the upper cymbal assembly, presses down on a spring-loaded sensor cylinder (not depicted) contained in sensor housing 34. As the sensor cylinder leaves the full-up position, the primary circuitry switch 45 is activated and the control current is varied by the primary control circuit. The output from this primary control circuit is sent out through the jack housing 39. In prior art, this output would go directly to the control input of the drum module, but in my invention, it is routed to the electronics control box 33 using connector 40 and jack 41. Note that only one control circuit is activated at any given time, and the circuit that is powered is the only one that will send signals to the drum module via the control jack 42 which leads to the drum module control input jack. Output line 46 is the pathway for the piezo triggering signal to be routed to the drum module when the impact sensitive electronic cymbal 108 has been struck.

An optional cymbal tilt switch 38 has been incorporated into the moving cymbal assembly. This switch transfers control to the tertiary or "sizzle" circuit when the cymbal is tilted, just as in other embodiments. Note that an electrical connection 43 is required between the electronics control box 33 and the switches 38 and 45 that are mounted above it.

FIGS. 10*a* and 10*b* illustrate an alternative placement of the primary circuitry switch 12 inside of the electronics control box 33. In this case, the primary circuitry switch 12 is activated by a cam 47 that is connected to a rod 37 that is connected to the foot pedal. In FIG. 10*a,* the pedal has been depressed, rod 37 has moved downward, and the cylindrical cam 47 which has been attached to the rod 37 and secured by set screw 48, moves down with it. The primary circuitry switch 12 gives control to the primary control circuit, wherever it may physically reside. In FIG. 10*b* the pedal is at or near the top of its spring-loaded travel, and the rod 37 and cam 47 have both moved up inside of the high-hat support tube 46. The primary circuitry switch 12 has moved with the cam 47 and transferred control to the secondary control circuit. The drawings show that a huge section of the support tube 46 has been cut away (for illustration purposes), but in reality, only a portion corresponding to the size of the switch cam follower 49 would need to be removed.

While all electronic drum modules use the same two inputs (pedal position and cymbal triggering) from the electronic high-hat instrument, the actual configuration may vary. My invention works with all of them. This invention ensures that the high-hat is always a pleasant sounding instrument, wherever the drummer's foot happens to be. Note that there is no distracting effort required on the part of the drummer.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

What I claim as my invention is:

1. An electronic high-hat circuitry system comprising:

an impact sensitive cymbal or other electronic triggering device which is struck by a drummer;

an electronic drum module used to convert the signals from said triggering device into musical instrument sounds;

a foot pedal which has an at-rest position that is at the top of its travel length;

a primary control circuit which sends electrical signals to said drum module based upon the position of said foot pedal, said signals being used by the drum module to determine the tonal qualities of a high-hat instrument, whenever said foot pedal is not at or near the top of its travel length;

a secondary control circuit which sends electrical signals to said drum module based upon a manually selected control signal, said signal being used by the drum module to determine the tonal qualities of a high-hat instrument, whenever said foot pedal is at or near the top of its travel length;

a primary circuitry switch which electrically disables said primary control circuit, and activates said secondary control circuit when said foot pedal is at or near the top of its travel length, and disables said secondary control circuit and activates said primary control circuit at all other times, said secondary control circuit comprising;

a means of manually varying the electrical signals supplied to said drum module utilizing a switch, resistors, a potentiometer, or a combination thereof;

a control panel comprising a knob, switch or slider device which allows the drummer to manually vary the control current supplied to said drum module when said secondary circuit is activated.

2. An electronic high-hat circuitry system according to claim 1, wherein:

the foot pedal is part of an assembly that houses and directly controls the primary control circuit.

3. An electronic high-hat circuitry system according to claim 1, wherein:

the foot pedal is connected to a rod that connects to a device that controls the primary control circuit.

4. An electronic high-hat circuitry system according to claim 1, wherein:

the primary circuitry switch is activated by the foot pedal itself when it reaches the top of its travel.

5. An electronic high-hat circuitry system according to claim 1, wherein:

the primary circuitry switch is activated by the movements of a device that controls the primary control circuit, said device linked to the foot pedal using a rod.

6. An electronic high-hat circuitry system according to claim 1, wherein:

the primary circuitry switch is activated by a cam that is connected to a rod that is connected to the foot pedal.

7. An electronic high-hat circuitry system according to claim 1, wherein:

a tertiary circuitry switch electrically disables the secondary control circuit, and activates a tertiary control circuit whenever the primary control circuit is not in use and said impact sensitive cymbal or other electronic triggering device has been tilted, and said tertiary circuitry switch disables said tertiary control circuit and activates said secondary control circuit whenever said triggering device is not tilted and said primary control circuit is not in use, said tertiary circuit comprising:

a means of manually varying the electrical signals supplied to said drum module utilizing a switch, resistors, a potentiometer, or a combination thereof, said signals being used by the drum module to determine the tonal qualities of a high-hat instrument;

a control panel comprising a knob, switch or slider device which allows the drummer to manually vary the control current supplied to said drum module when said tertiary circuit is activated.

8. An electronic high-hat circuitry system according to claim 7, wherein:

a tertiary circuit cymbal platform is used to support said impact sensitive cymbal or other electronic triggering device, said cymbal platform comprising:

a central support post that enables cymbal tilting.

9. An electronic high-hat circuitry system according to claim 8, wherein:

said cymbal platform includes a tertiary circuitry switch that is activated when the cymbal is tilted.

10. An electronic high-hat circuitry system according to claim 8, wherein:

a return spring or other elastic device is used to restore said cymbal to an at-rest position that is not tilted.

11. An electronic high-hat circuitry system according to claim 10, wherein:

said return spring has an adjustment device that allows the drummer to vary the return spring tension.

12. An electronic high-hat circuitry system according to claim 8, wherein:

support arms define a fulcrum line for the cymbal to tilt in a direction facing the drummer.

13. An electronic high-hat circuitry system according to claim 12, wherein:

said support arms can be adjustably positioned relative to the central support post.

14. An electronic high-hat circuitry system according to claim 12, wherein:

said support arms have stanchions that support and guide said cymbal.

15. An electronic high-hat circuitry system according to claim 14, wherein:

said stanchions are adjustable in height.

* * * * *